United States Patent [19]

Awano et al.

[11] 4,141,343

[45] Feb. 27, 1979

[54] HOT-WATER BOILER OF THE DIRECT-HEATING TYPE

[75] Inventors: Seiichi Awano; Matsuo Nishimura, both of Tokyo, Japan

[73] Assignee: Seiichi Awano and Yasui Sangyo Co., Ltd., Tokyo, Japan

[21] Appl. No.: 767,506

[22] Filed: Feb. 10, 1977

[30] Foreign Application Priority Data

Dec. 2, 1976 [JP] Japan ..... 51/143956

[51] Int. Cl.[2] ..... F24H 1/20

[52] U.S. Cl. ..... 126/360 A; 122/20 A

[58] Field of Search ..... 126/374, 380, 360 A; 122/20 A; 431/171, 353

[56] References Cited

U.S. PATENT DOCUMENTS

| | | | |
|---|---|---|---|
| 2,233,675 | 3/1941 | Narten | 126/360 A |
| 2,721,607 | 10/1955 | Damon et al. | 431/171 |
| 3,131,335 | 4/1964 | Berglund et al. | 73/304 R |
| 3,170,479 | 2/1965 | Mueller | 73/304 R |
| 3,956,760 | 5/1976 | Edwards | 73/304 R |
| 3,994,281 | 11/1976 | Godart | 122/20 A |

FOREIGN PATENT DOCUMENTS

| | | | |
|---|---|---|---|
| 30664 | 10/1970 | Japan | 126/360 A |

*Primary Examiner*—John J. Camby
*Assistant Examiner*—Larry I. Schwartz
*Attorney, Agent, or Firm*—Zarley, McKee, Thomte, Voorhees & Sease

[57] ABSTRACT

A hot-water boiler of the direct-heating type basically comprising a combustion chamber and a heat-exchange chamber which encircles the lower half part of the combustion chamber and which has a number of reticulate plates therein. Combustion gas generated in the combustion chamber effuses into the heat-exchange chamber where water to be boiled is stored. The combustion gas goes through the water in the heat-exchange chamber and is broken up into smaller bubbles by the reticulate plates; thereby facilitating a prompt and efficient heat-exchange between the gas and water.

16 Claims, 3 Drawing Figures

HOT-WATER BOILER OF THE DIRECT-HEATING TYPE

Figure 1:
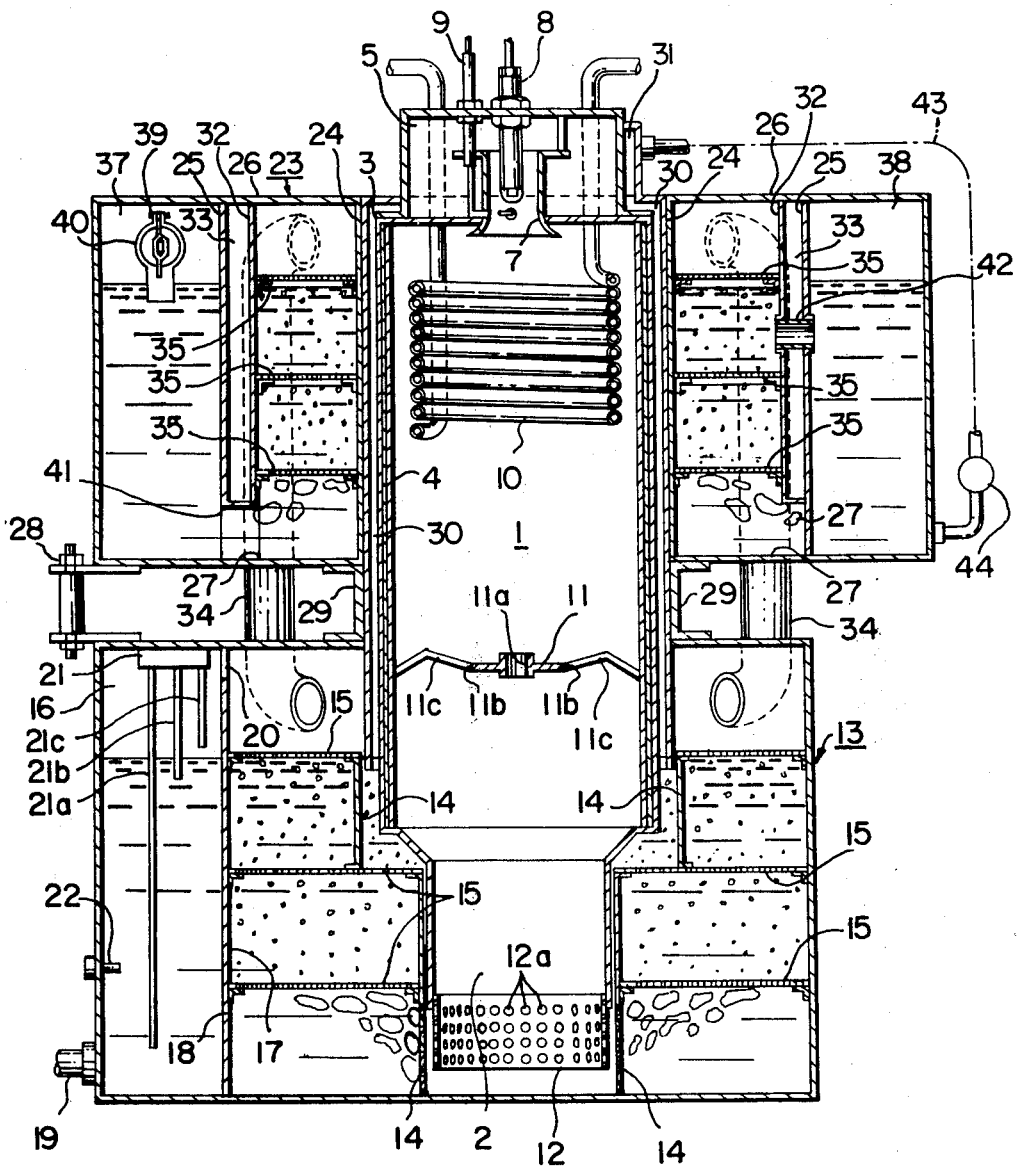

The present invention generally relates to hot-water boilers adapted for obtaining hot water to be used in washing or cleaning industrial machinery, vehicles or the like or for other similar purposes, and more particularly relates to a hot-water boiler of the direct-heating type in which combustion gas goes through water to cause direct heat-exchange to occur between the combustion gas and the water.

One difficulty in the conventional hot-water boiler is that heat transmission from the combustion gas to the water is relatively slow since heat-exchange between them takes place indirectly through metal plates or pipes. Furthermore, in order to expand heat-exchange area for increasing the temperature of the hot water, there have to be provided a large number of pipes in the boiler.

Therefore, a prime object of the present invention is to provide a hot-water boiler of the direct-heating type which is free from the above difficulties of the prior art and has a high thermal efficiency.

According to one aspect of the invention, there is provided a heat-exchange chamber encircling the lower half part of a combustion chamber whose lower end is open. Combustion gas generated in the combustion chamber effuses into the heat-exchange chamber from the bottom opening of the combustion chamber. Within the heat-exchange chamber, an adequate number of gas-dividing plates are horizontally supported and are adapted to break up the combustion gas into smaller bubbles so as to increase the contact area of the combustion gas with the water, thereby facilitating prompt and efficient heat-exchange between them.

According to another aspect of the invention, there is further provided a preheating chamber for making best use of the heat of the combustion gas, said chamber being located above and generally coaxial with the heat-exchange chamber so as to encircle the upper half part of the combustion chamber. Within this preheating chamber, there are provided an adequate number of gas-dividing plates, similar to those disposed in the heat-exchange chamber, to break up into smaller bubbles the combustion gas which has already passed through the heat-exchange chamber.

Each of the gas-dividing plates is formed, preferably, of with a finely-meshed or porous plate. Their provision within the heat-exchange or preheating chamber not only lends itself to increasing the heat-exchange rate, but also enables the height of the chambers to be reduced. Therefore, the effusion pressure of the combustion gas can be considerably reduced.

According to a further aspect of the invention, there is provided a reheating pipe within the combustion chamber which reheats the water after it has been heated in the heat-exchange chamber, whereby it becomes possible to obtain hot water having a higher temperature.

Figure 2:
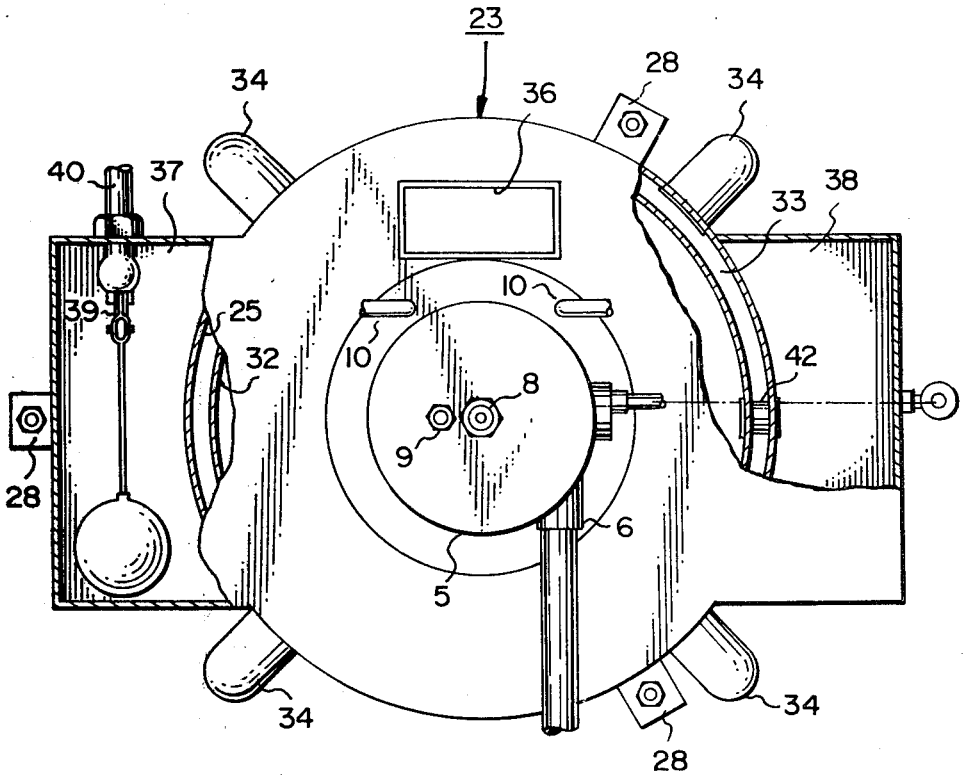
Figure 3:
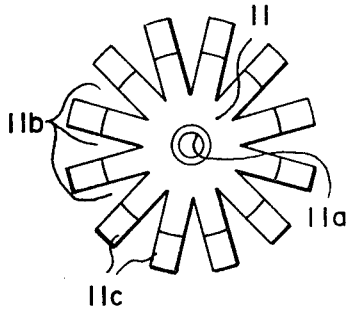

The above and other objects and features of the invention will be made more apparent when one of the preferred embodiments of the invention is described with reference to the accompanying drawings, in which;

FIG. 1 is a sectional front view of a hot-water boiler of the present invention, FIG. 2 is a plan view of the same, and FIG. 3 is a plan view of a bored diaphram disposed in the combustion chamber.

Referring now to FIGS. 1 to 3, the reference numeral 1 is indicative of a combustion chamber of substantially cylindrical shape, of which the bottom portion 2 is open. The inner surface of its outer wall 3 is covered with a suitable heat-resistant layer 4. The combustion chamber 1 is provided at its top portion with an air chamber 5 having a compressed-air inlet 6 — See FIG. 2 —, through which compressed air is introduced into the air chamber 5. Compressed air in the air chamber 5, passing through an outlet pipe 7 of the diffuser type centrally provided at the top wall of combustion chamber 1, effuses into the latter.

A fuel injection nozzle 8 which is secured to the top of the air chamber 5 protrudes into the air outlet 7, and an ignition device 9 is so disposed that its operative tip laterally protrudes into the air outlet pipe 7; thus the former and the latter constitute a burner.

Disposed within the combustion chamber 1 at its upper portion is a reheating pipe 10 which is coiled up closely in a spiral manner. Both of its end portions extend upward and penetrate the top wall of chamber 1. Also disposed in the chamber 1 below the reheating pipe 10 is a horizontal diaphram 11 of a shape, for example, as shown in FIG. 3. This diaphram 11 is aimed at keeping the combustion area at the highest possible temperature so as to effect perfect combustion of the fuel.

As is shown in FIG. 3, the diaphram 11 is provided with a circular bore 11*a* at its central portion and with a plurality of radially-extending notches 11*b* around its circumference. Preferably, each leg portion 11*c* is slightly bent up so as to avoid adverse effects which could possibly be caused by thermal expansion or contraction.

At the bottom opening of combustion chamber 1, there is provided a cylindrical member 12 on whose lateral wall numerous small holes 12*a* are formed.

The reference numeral 13 indicates a heat-exchange chamber which has a substantially cylindrical shape and both end portions of which are closed. The lower half part of the combustion chamber 1 is inserted into this heat-exchange chamber 13, within which an adequate number of disc-shaped gas-dividing plates 15 are horizontally supported properly spaced apart from each other by a vertically-extending cylindrical spacer 14 having numerous holes and being disposed around the bottom opening 2 of the chamber 1. Each of the gas-dividing plates 15, having the form of a finely-meshed or porous plate, serves to break up combustion gas into smaller bubbles.

In FIG. 1, a hot water storage tank 16 is provided at the left-hand side of the heat-exchange chamber 13, being partitioned off from the chamber 13 by a vertical partition wall 17. A passage hole 18 of suitable size is formed on the lower portion of said partition wall 17. Thus, water, which has been supplied into chamber 13 through a suitable inlet pipe (not shown) and then heated therein by combustion gas, can flow through the passage hole 18 into the storage tank 16, where hot water is temporarily retained to make water-gas separation effective.

After this water-gas separation, hot water is taken out through an outlet pipe 19 disposed at the lower portion of the storage tank 16. On the other hand, partition wall 17 has at its upper portion a hole 20 to reflux combustion gas separated from water into the heat-exchange chamber 13. Combustion gas used in the chamber 13 is then exhausted through an outlet hole (not shown) formed on the top wall of the chamber 13. However, the used gas may also be used again, instead of merely exhausting it from chamber 13 after use, for a purpose to be described hereinafter.

The outlet pipe 19 is directly connected to a suitable hot water supply pipe, which is not shown, and which extends to the site where hot water is actually used. However, it is more effective to connect outlet pipe 19 to one end of the aforementioned reheating pipe 10 in combustion chamber 1; thereby reheating the hot water to an even high temperature. Then, this reheated water is taken out at the other end of the reheating pipe 10 and supplied to the required site.

In order to maintain the water level in tank 16 within a certain range, it has therein a water-level detecting means 21 comprising three metal prongs 21*a*, 21*b* and 21*c* extending downward from the roof of tank 16 and each having a different length. A suitable voltage is applied between the longest leg 21*a* and the two others 21*b* and 21*c*. Therefore, if the longest leg 21*a* and the shortest one 21*c* are electrically connected, it shows that the water level in the tank 16 has reached an upper limit, while an interruption of the electric connection between the longest 21*a* and the middle one 21*b* indicates that the water-level has passed its lower limit. This detecting means 21 controls water-supply means (not shown) to determine the amount of water to be supplied to chamber 13.

Storage tank 16 is further provided slightly below its center with a heat-sensitive member 22 adapted to stop the operation of a fuel pump (not shown) immediately when there is no water left in the tank 16. Thus, burning of fuel in the combustion chamber 1 when the tank is dry can be prevented.

The reference numeral 23 indicates a preheating chamber to be called a second heat-exchange chamber, said chamber 23 being annular-shaped and comprising cylindrical inner and outer walls (24 and 25) and top and bottom walls (26 and 27). This preheating chamber 23 is located above and generally coaxial with first heat-exchange chamber 13, and is secured to chamber 13 by suitable fixing members 28 and 29 to encircle the upper half part of combustion chamber 1. As can best be seen in FIG. 2, between the inner wall 24 of preheating chamber 23 and the outer wall 3 of combustion chamber 1, there is formed an annular gap which constitutes a water path 30 for guiding preheated water from an inlet gate 31 disposed at one side of the air chamber 5 into heat-exchange chamber 13.

Depending from top wall 26 down to the vicinity of bottom wall 27 is a cylindrical partition wall 32 of smaller diameter than the outer wall 25, between which an annular passage 33 having its upper end closed is formed. This annular passage 33 is connected to heat-exchange chamber 13 by means of generally U-shaped pipes 34 — four pipes are shown in FIG. 2 — the lower ends of which are opened into the upper space of chamber 13 and the upper ends of which are also opened into annular passage 33. Accordingly, it becomes possible to introduce combustion gas already used in chamber 13 into annular gas passage 33.

An adequate number of gas-dividing plates, similar to those disposed in heat-exchange chamber 13, are horizontally supported between the cylindrical partition wall 32 and inner wall 24. Top wall 26 of preheating chamber 23 has an outlet hole 36 for exhausting combustion gas, as shown in FIG. 2.

Provided at opposite sides of preheating chamber 23 are a water-level regulation tank 37 and a preheated water storage tank 38. A supply pipe 40 having a float valve 39 of the conventional type is fixed to the upper portion of the water-level regulation tank 37. Water which has been supplied through the pipe 40 flows into the preheating chamber 23 through a hole 41 made in the lower portion of outer wall 25. Meanwhile, the storage tank 38 is connected to the preheating chamber 23 via a connection pipe 42 penetrating both the outer wall 25 and partition wall 32. A conduit 43 extending up to the inlet gate 31 is connected to the above storage tank 38 at its lower portion, said conduit 43 being provided with a pump 44 of which actuation is dependent upon a detected low value of water-level sensed by water-level detecting means 21.

With the foregoing description in mind, attention is now directed to the operation of the hot-water boiler of the direct heating type of the invention, particularly with reference to FIG. 1.

Combustion gas generated in the combustion chamber 1 effuses through the numerous holes 12*a* of the cylindrical member 12 into the heat-exchange chamber 13 which is filled with water, where as the gas rises up toward the water surface, it is gradually broken up into smaller bubbles by the gas-dividing plates 15, and heat-exchange between the gas and the water takes place. The combustion gas which collects at the top of the heat-exchange chamber 13 then flows into the annular passage 33 through the pipes 34. Thereafter, it effuses from the opened bottom of the passage 33 into the preheating chamber 23, where it is again broken up by gas-dividing plates 35 during its rise to the water surface. It is then exhausted from the outlet hole 36 formed on the top wall of the preheating chamber 23.

On the other hand, water, which has been supplied through the supply pipe 40 into the water-level regulation tank 37 up to the predetermined level, flows via the hole 41 into the preheating chamber 23, in which said water is in contact with and is heated in advance by combustion gas which has gone through the heat exchange chamber 13. Water thus preheated, after finding its way into storage tank 38 through connection pipe 42, is temporarily kept in the tank 38 while the gas becomes completely separated from the water.

This preheated water is then delivered through the conduit 43 up to the inlet gate 31 by means of the pump 44, which is switched on whenever the detecting means 21 detects that the water-level in the tank 16 is below the present lower limit. Then, the water passes the annular water path 30 along the outer wall of combustion chamber 1 down to the heat-exchange chamber 13, while cooling off the outer wall 3. This water, after being directly heated by combustion gas in the heat-exchange chamber 13, is sent to the storage tank 16 so as to complete gas-water separation.

As has been referred to before, though hot water may be taken out directly from the outlet pipe 19, it is preferred to reheat it by means of the reheating pipe 10 disposed within combustion chamber 1.

While a preferred embodiment of the invention has been described heretofore in detail, it should be understood that various modifications can be made without departing from the broader scope of the present invention.

What we claim is:

1. A hot-water boiler of the direct-hearing type comprising:

(a) a combustion chamber whose lower end is open, (b) fuel supplying means for supplying combustion fuel into said combustion chamber, (c) a heat-exchange chamber encircling the combustion chamber and adapted to contain water, (d) water supplying means for supplying water into the heat exchange chamber at an upper portion thereof, (e) water outlet means for withdrawing water after it has been heated in the heat-exchange chamber, from a lower portion thereof, (f) gas outlet means for exhausting combustion products from the heat-exchange chamber, located at an upper portion thereof, (g) a plurality of substantially horizontally disposed gas-dividing plates spaced apart within said heat-exchange chamber, said plates adapted to break up into smaller bubbles the combustion gases discharged from the combustion chamber and rising through the heat-exchange chamber, and further adapted to effect efficient heat exchange between the combustion gases rising and the water percolating downwards, and (h) a hot-water storage tank where hot water discharged from the heat-exchange chamber is temporarily kept so that water-gas separation may be completed in the storage tank.

2. A hot-water boiler of the direct heating type according to claim 1, further including a reheating pipe disposed within the combustion chamber, one end of said pipe being connected to said water outlet means so as to reheat hot water supplied from the heat-exchange chamber.

3. A hot-water boiler of the direct-heating type according to claim 1, said tank having therein water-level detecting maens adapted to detect the level of water kept in said tank.

4. A hot-water boiler of the direct-heating type according to claim 1, further including a diaphram having a central bore thereon, said diaphram being disposed at an approximately central portion of the combustion chamber so as to keep the combustion area at a high temperature for effecting perfect combustion of fuel.

5. A hot-water boiler of the direct-heating type according to claim 1, each of said gas-dividing means being formed of a finely-meshed or porous plate.

6. A hot-water boiler of the direct-heating type comprising:

(a) a combustion chamber whose lower end is open, (b) fuel supplying means for supplying combustion fuel into said chamber, (c) a heat-exchange chamber encircling a lower portion of the combustion chamber and adapted to contain water, (d) a preheating chamber located above the heat-exchange chamber to encircle an upper portion of the combustion chamber, adapted to contain water, (e) water supplying means for supplying water into the preheating chamber, (f) feeding means for feeding water from the preheating chamber into the heat-exchange chamber, (g) water outlet means for exhausting water heated in the heat-exchange chamber, (h) duct means connecting between an upper portion of the heat exchange chamber and a lower portion of the preheating chamber, said duct means being adapted to introduce the combustion products from the heat-exchange chamber to the preheating chamber, (i) gas outlet means for exhausting combustion products from the preheating chamber, located at an upper portion thereof, (j) a first set of at least one gas-dividing plate substantially horizontally disposed within said heat-exchange chamber, said plate adapted to break up into smaller bubbles the combustion gases discharged from the combustion chamber and rising through the heat-exchange chamber, and further adapted to effect efficient heat exchange between the combustion gases rising and the water percolating downwards, and (k) a second set of at least one gas-dividing plate substantially horizontally disposed within said preheating chamber, said plate adapted to break up into smaller bubbles the combustion gases discharged from the connecting duct means and rising through the preheating chamber, and further adapted to effect efficient heat exchange between the combustion gases rising and the water percolating downwards.

7. A hot-water boiler of the direct-heating type according to claim 6, further including a reheating pipe disposed in the combustion chamber, one end of said pipe being connected to said water outlet means so as to reheat hot water discharged from the heat-exchange chamber.

8. A hot-water boiler of the direct-heating type according to claim 6, further including a hot-water storage tank where hot water discharged from the heat-exchange chamber is temporarily kept so so that water-gas separation may be completed in the storage tank.

9. A hot-water boiler of the direct-heating type according to claim 8, said tank having therein water-level detecting means adapted to detect the level of water kept in said tank.

10. A hot-water boiler of the direct-heating type according to claim 9, said detecting means comprising three legs of the different length, a voltage being applied between the longest leg and two others so as to detect the higher limit or lower limit of the water level.

11. A hot-water boiler of the direct-heating type according to claim 9, said feeding means being provided with a pump operating selectively in accordance with said water-level detecting means.

12. A hot-water boiler of the direct-heating type according to claim 6, further including a preheated water storage tank where water preheated in the preheating chamber is temporarily kept so that water-gas separation may be completed in the storage tank.

13. A hot-water boiler of the direct-heating type according to claim 6, further including a diaphram having a central bore thereon, said diaphram being disposed at an approximately central portion of the combustion chamber so as to keep the combustion area at a high temperature for effecting perfect combustion of fuel.

14. A hot-water boiler of the direct-heating type according to claim 6, said feeding means including an annular water path formed between the outer wall of the combustion chamber and the inner wall of the preheating chamber.

15. A hot-water boiler of the direct-heating type according to claim 6, said preheating chamber including an annular gas passage with its top end closed into which the upper ends of the connecting pipes are opened.

16. A hot-water boiler of the direct-heating type according to claim 6, each of said gas-dividing plates being formed with a finely-meshed or porous plate.

* * * * *